US005722475A

United States Patent [19]

Lammi

[11] Patent Number: 5,722,475

[45] Date of Patent: Mar. 3, 1998

[54] METHOD AND DEVICE FOR DRESSING LOGS

[76] Inventor: Matti K. Lammi, Kaasmarkuntie. 129, FIN-28450 Vanha-Ulvila, Finland

[21] Appl. No.: 700,491

[22] PCT Filed: Mar. 6, 1995

[86] PCT No.: PCT/FI95/00124

§ 371 Date: Sep. 4, 1996

§ 102(e) Date: Sep. 4, 1996

[87] PCT Pub. No.: WO95/24300

PCT Pub. Date: Sep. 14, 1995

[30] Foreign Application Priority Data

Mar. 8, 1994 [FI] Finland ..... 941074

[51] Int. Cl.[6] ..... B27L 1/00; B27M 1/00

[52] U.S. Cl. ..... 144/363; 144/4; 144/24.13; 144/208.8

[58] Field of Search ..... 144/2.1, 4, 24.13, 144/208.1, 208.2, 208.8, 329, 341, 343, 363

[56] References Cited

U.S. PATENT DOCUMENTS

| | | | |
|---|---|---|---|
| 2,646,092 | 7/1953 | Kolpe et al. | 144/208.8 |
| 2,767,750 | 10/1956 | Skwart | 144/208.8 |
| 2,779,363 | 1/1957 | Laughton | 144/208.8 |
| 2,799,304 | 7/1957 | Stewart | 144/208.8 |
| 3,789,893 | 2/1974 | Carson et al. | 144/208.8 |
| 3,913,644 | 10/1975 | Braun | 144/208.8 |
| 4,303,111 | 12/1981 | Neville | 144/4 |

*Primary Examiner*—W. Donald Bray
*Attorney, Agent, or Firm*—Ladas & Parry

[57] ABSTRACT

An apparatus and method for machining the surface of logs, in which the log is longitudinally advanced through an opening provided in a rotor disc and the surface of the log is machined by rotatable cutting heads mounted on respective supporting arms pivotably connected to the rotatable disc and rotating therewith around the logs. The cutting heads are rotated around respective axes of rotation, while concurrently the cutting heads rotate with the rotor disc around the log such that the net rotational speed of the cutting heads at the surface of the log is the sum of the speed of rotation produced by the rotatable disc and the speed of rotation of the cutting heads around their respective axes. In the course of machining the logs, the speed of rotation of the rotor disc is varied as a function of conditions at the surface of the log and the rotational speed of the cutting heads around their axes is varied in relation to the rotational speed of the rotor disc to maintain a substantially constant net rotational speed of the cutting heads at the surface of the log.

12 Claims, 2 Drawing Sheets

METHOD AND DEVICE FOR DRESSING LOGS

FIELD OF THE INVENTION

The invention relates especially to machining logs with natural shape such as those used for poles and log houses. The method and device of the invention enable flexible adjustment of working parameters during the machining operation.

BACKGROUND AND PRIOR ART

Machines of hollow-rotor type are known and widely used for debarking of logs. Dressing of poles is done by rotating the log rotates. Due to difficulties in controlling the centrifucal forces, the performance is limited. When the length and bow of the log increases, the hollow-rotor principle becomes advantageous also in dressing the logs. As in such a case the rotor speed must be kept at a relatively low level, the best surface finish is achieved by using fast rotating cutting heads. Cutting heads are attached to supporting arms which are pivoted at the rotor disc and turn the cutting heads against the log substantially in a radial direction in relation to the log. Owing to requirements related to balancing and efficiency, the number of arms with corresponding cutting heads is normally two at the minimum. The arms let the cutting heads float against the log under a force, produced, for example, by springs, counter weights or such. The drive for rotating the cutting heads is obtained simply from a wheel attached a stationary body by means of a gear-chain-or belt transmission. When rotating, the rotor disc also provides drive for the attached power transmissions of the cutting heads, too. A typical basic solution is described in a patent publication DE 2027399.

Hollow-rotor lathes with rotating cutting heads have not proven popular due to limitations related to solutions of the prior art, especially due to poor controllability. Practically the only easily controllable feature has been the longitudinal feed rate. This isn't enough. In pole dressing the diameter of the very same pole may range within 15–35 cm. Butt flare, bow and other irregularities increase the variations further. Therefore a possibility to adjust the rotor speed 1s necessary. But this changes the speed of rotation of the cutting heads affecting the quality and efficiency of machining very adversely.

When initiating the machining the cutting tools climb on the log in a screw form of movement. The method is widely used in debarking machines and described e.g. in patent publication FI 28928. The shapes of cutter supporting arms which enable the climbing, have been described in numerous patent publications e.g. FI 35237. In debarking machines climbing along the guidance of the supporting arm is a straight forward and practical way. The parent publication FI 81993 describes a similar solution adapted to a lathe. In such case the mass of the cutter supporting arms should be kept low, however, they must be strong enough. Because in practise both requirements are difficult to fulfil simultaneously, is desirable to limit the impact force applied on the supporting arms.

During the machining, especially when dressing poles, it is frequently necessary to change the cutting depth even within the range 1–10 mm along same pole. With the hollow-rotor lathes of the prior the cutting depth can be changed by means of an adjustable follower which, however, cannot be adjusted during the machining operation. Furthermore a follower of the prior art forces the cutting head to jump up when encountering local surface irregularities, such as poorly sawn branches, which worsens the surface finish. Several patent documents e.g. DE P 2320450.4 ( FI 1184/74), FI 40044 describe various methods for adjusting the force applied on cutting heads to push them against the log. The adjustment can be executed even during machining operation. By this way, however, the cutting depth cannot be adjusted accurately enough.

SUMMARY OF THE INVENTION

The object of the present invention is to provide a system in which the drawbacks above can be eliminated by employing non-sophisticated techniques.

The system according to the invention enables maintaining constant rotational speed at the cutting heads even though the rotor speed is varied within a wide range. When feeding the log in the lathe, the cutting heads are transferred upon it without applying high stresses to the supporting arms. During the machining operation, the cutting depth can be adjusted steplessly and accurately by means of a follower mating with the log contour. The adverse effect of local surface irregularities for the cutting accuracy can be eliminated to a large extent.

DESCRIPTION OF THE DRAWINGS

An embodiment of the invention is described is in the following, with reference to the drawings in which.

Figure 1:
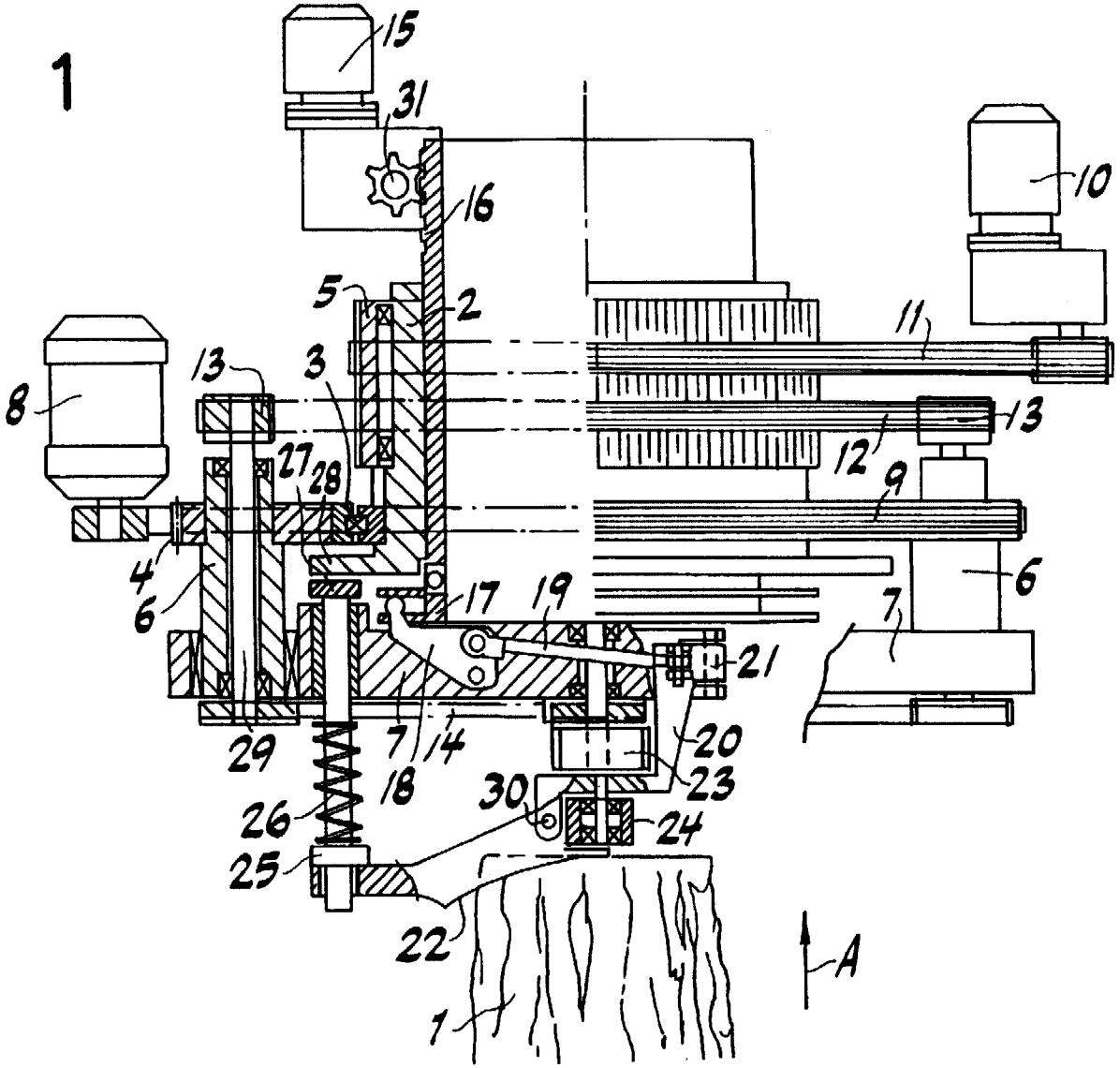
FIG. 1 is a cross-sectional view through a machining device according to the above, left side as a cross section
Figure 2:
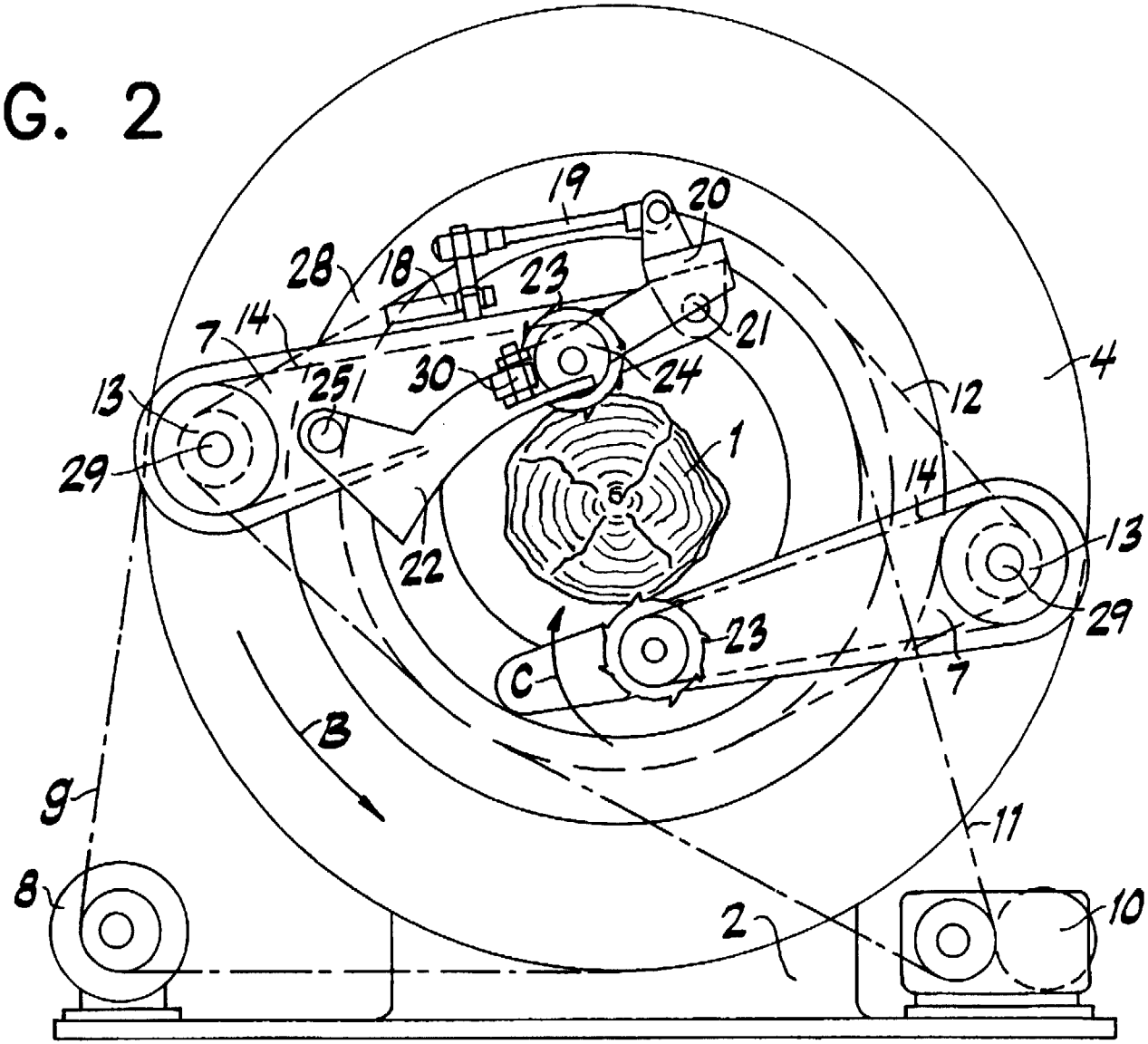
FIG. 2 is a the front view of the machining device at the log entry side, where the systems for the cutting depth adjustment and climbing on the log are shown on one arm the power transmission system in another.

For the sake of clarity the illustrations are in a simplified form, partly with dimensions out of proportion.

DETAILED DESCRIPTION

According to the drawings a rotor disc 4 is attached to a stationary frame 2. In the middle of the rotor disc 4 there is an opening at least large enough to accommodate the log to be machined. Upon the rotor disc, substantially at the same distance from the center, are attached at least two bearing assemblies 6 which accommodate supporting arms 7 for pivotable movement. Cutting heads 23 are attached at the other end of the supporting arms.

Rotary drive for the rotor disc 4 is obtained from the actuator 8 preferably by means of a belt transmission 9. Rotary drive for the cutting heads 23 is produced by the difference in rotational speeds between the rotor disc 4 and a wheel 5 swivelling in the frame 2. The bearing assembly 6 accommodates a shaft 29 which is driven in rotation by the wheel 5 by means of a belt 12 and a wheel 13. Rotary motion is transferred further to the cutting head 23 by the shaft 29 through a belt transmission 14.

The wheel 5 is caused to rotate in relation to the frame 2 by an actuator 10 through a belt transmission 11. This enables the adjustment of the rotational speed of cutting heads 23 without affecting the rotational speed of the rotor disc 4.

In practice it is preferable to adjust the speed of the rotor disc 4 almost continuously due variations in log diameter, surface finish, irregularities and the like. The required scope of rotational speed to be varied is wide, e.g. 60–240 rpm in pole dressing. Conversely, the rotational speed of the cutting head should be kept nearly constant regardless of variations in the rotor speed. The solution according to this invention preferably is as follows.

The speed of the rotor disc 4 is controlled according to needs stated above either manually or automatically. The change in the speed of the cutting head 23 caused by the control action is eliminated by changing simultaneously the rotational speed of the wheel 5 in due proportion. In this way the not rotational speed of the cutting head 23 is kept within the desired limits.

The way to execute the control is known as such and can be done e.g. by applying inverters.

In mobile applications a solution based on hydraulics may be preferable.

Supporting arms 7 are forced towards the center by employing methods of the prior art e.g. by means of springs or counterweights which are not shown in the attached drawings.

The log is fed in the machining device by employing centering- and feeding equipment of the prior art, in the direction of the arrow A. At first the log meets a guide 22 which backs in the guidance of a link 30 and pushes a sleeve 25 against a spring 26 towards the frame of the machine until a friction pad 27 at the other end of the sleeve contacts a mating surface 28 on the frame 2. The rotor disc 4 rotating counter-clockwise (direction B) with a moment of forces nearly at the distance between the axis of the bearing 6 and the sleeve 25, tries to turn the supporting arm 7 counter-clockwise i.e. out from the log center thus easing its climbing upon the log 1 which takes place with a screw form movement.

The lightening effect of the sleeve 25 is strongest just at the beginning of climbing and decreases when the contact point of the guide 22 against the log gets closer to the follower 24. Finally the supporting arm 7 along with the attached equipment moves upon the log surface to be supported by the follower 24.

The difference between the distances of the follower 24 and the cutting head 23 from the log 1, substantially in the radial direction, determines the cutting depth. Said difference can be adjusted even during the machining operation as follows. A rack 16 is shifted means of a pinion 31 by an actuator 15 in the direction substantially parallel to the equipment axis. A coupling disc 17 attached at the other end of the rack 16 consequently turns a lever 18 which by means of connecting rod 19 turns a supporting lever 20. And the follower 24, attached to the supporting lever 20, swings under the guidance of a joint 21 nearly in a radial direction in relation to the log 1. The above mechanism for shifting the follower as such is known e.g. from clutches and gear boxes.

Two supporting arms 7 at the minimum enable overlapping the working paths of cutting heads 23. Increasing the number of supporting arms 7 further improves the possibilities to apply a method described below. In order to be able to maintain the cutting depth at the proper level, despite local irregularities on the log surface, at least one cutting head 23 in corresponding supporting arm 7 can be placed further than the others in the direction A of log 1 entry. Then the followers 24 of the other supporting arms 7, locating behind, face a pre-machined surface of the log 1, where the worst irregularities have been cut off already.

Although but limited embodiments of the present invention have been described, it is anticipated that numerous changes and modifications will be apparent to those skilled in the art, and that such changes may be made without departing from the invention as defined by the following claims. Especially the power transmissions and coupling mechanisms can be made in many alternative ways.

What is claimed is:

1. Apparatus for machining logs comprising:

a frame, a rotatable disc rotatably supported from the frame, means for rotating said disc, a pair of supporting arms connected to said disc for rotation therewith, said arms being mounted on said disc for pivotal movement relative to said disc, cutting heads rotatably mounted at free ends of said supporting arms, means for rotating said cutting heads around respective axes of rotation, means for advancing a non-rotating log through an opening provided in said rotatable disc with said cutting heads engaging an outer surface of the log and rotating therearound by the rotation of said disc while rotating around their respective axes, said cutting heads having a net rotational speed at the surface of the log which is the sum of the speed of rotation produced by the rotatable disc and the speed of rotation of the cutting heads around their respective axes, and means for varying the rotational speed of the cutting heads around their respective axes in relation to the rotational speed of said disc to maintain a substantially constant net rotational speed of said cutting heads.

2. Apparatus as claimed in claim 1, wherein said means for rotating said cutting heads around their respective axes comprises a rotational drive means, a wheel rotatably mounted on said frame and driven by said rotational drive means and a transmission drivingly connecting said wheel and said cutting heads.

3. Apparatus as claimed in claim 2, wherein said cutting heads are mounted on opposite sides of said log.

4. Apparatus as claimed in claim 2, wherein said means for varying the rotational speed of the cutting heads around their respective axes comprises means for varying rotational speed of said wheel on said frame.

5. Apparatus as claimed in claim 1, comprising a follower associated with each supporting arm for controlling depth of cut of the respective cutting head in the log, and means for adjusting the follower to adjust the depth of cut.

6. Apparatus as claimed in claim 5, comprising means for frictionally engaging the follower with said frame when said log initially contacts said follower to cause said rotatable disc to displace said follower radially and ease the rotatable cutting head onto the log.

7. Apparatus as claimed in claim 1, wherein at least one of said cutting heads is axially displaced with respect to the other cutting heads in a rearwards direction from the advance of the log so that said at least one cutting head machines an already machined surface of the log.

8. A method for machining logs comprising:

longitudinally advancing a log to be machined through an opening provided in a rotatable disc, supporting a plurality of rotatable cutting heads on respective supporting arms pivotably connected to said rotatable disc, said arms and said cutting heads rotating with said disc around said log, the speed of rotation of said disc being varied as a function of conditions at the surface of the log, rotating said cutting heads around respective axes of rotation while concurrently rotating said cutting heads with said disc around said log such that the net rotational speed of said cutting heads at the surface of the log is the sum of the speed of rotation produced by the rotatable disc and the speed of rotation of the cutting heads around their respective axes, and varying the rotational speed of the cutting heads around their respective axes in relation to the rotational speed of the disc to maintain a substantially constant net rotational speed of the cutting heads at the surface of the log.

9. A method as claimed in claim 8 comprising arranging said plurality of cutting heads around the log.

10. A method as claimed in claim 8, comprising adjusting a depth of cut of each cutting head into the log by engaging a follower with the respective supporting arm of each cutting head.

11. A method as claimed in claim 10, comprising rotating the follower radially when the log initially contacts the follower to ease the associated rotatable head onto the surface of the log.

12. A method as claimed in claim 8, comprising placing at least one cutting head rearward of the others relative to the longitudinal direction of advance of the log for machining an already machined surface of the log.

* * * * *